US008854269B2

(12) United States Patent
Bortoin et al.

(10) Patent No.: US 8,854,269 B2
(45) Date of Patent: Oct. 7, 2014

(54) COMPACT EMBEDDED ANTENNA

(76) Inventors: Robert S. Bortoin, Torrance, CA (US); Hao Xin, Tucson, AZ (US); Andrey Berezin, Torrance, CA (US); Jayanth Kudva, Torrance, CA (US); Hualiang Zhang, Denton, TX (US)

( * ) Notice: Subject to any disclaimer, the term of this patent is extended or adjusted under 35 U.S.C. 154(b) by 883 days.

(21) Appl. No.: 12/924,968

(22) Filed: Oct. 8, 2010

(65) Prior Publication Data

US 2011/0260935 A1 Oct. 27, 2011

Related U.S. Application Data

(60) Provisional application No. 61/278,670, filed on Oct. 8, 2009.

(51) Int. Cl.
*H01Q 1/32* (2006.01)

(52) U.S. Cl.
USPC ..... 343/713

(58) Field of Classification Search
USPC ..... 343/713, 767, 770, 700 MS, 711, 343/872–873
See application file for complete search history.

(56) References Cited

U.S. PATENT DOCUMENTS

| | | | | |
|---|---|---|---|---|
| 4,101,896 | A * | 7/1978 | Ikrath et al. | 343/713 |
| 4,866,453 | A * | 9/1989 | Nagy et al. | 343/712 |
| 5,859,616 | A * | 1/1999 | Gans et al. | 343/700 MS |
| 7,688,278 | B2 * | 3/2010 | Frenkel | 343/872 |
| 2012/0050114 | A1 * | 3/2012 | Li et al. | 343/702 |

* cited by examiner

*Primary Examiner* — Huedung Mancuso
(74) *Attorney, Agent, or Firm* — John R. Ross; John R. Ross, III

(57) ABSTRACT

An antenna embedded into armor plates. The armor material is of low dielectric constant preferably less than 20 permitting radio radiation to be emitted through the armor by the antenna. In a preferred embodiment the armor is a composite of different materials, with the antenna placed between elements of the armor, creating a multi-level design. The antenna elements are preferably printed for low-profile and ease of integration or the antenna elements can be fabricated from larger elements and placed into a space between vehicle and armor or in a cavity cut into the vehicle or armor.

8 Claims, 5 Drawing Sheets

| Frequency | Central Antenna | Parasitic Loop |
|---|---|---|
| 178 MHz | 103.5mm | 120.5mm |
| 300 MHz | 86mm | 103mm |
| 435 MHz | 71mm | 88mm |
| 1000 MHz | 35.5mm | 52.5mm |
| 1470 MHz | 25.4mm | 42.4mm |
| 1800 MHz | 25.4mm | 42.4mm |

FIG. 6

COMPACT EMBEDDED ANTENNA

CROSS REFERENCED TO RELATED APPLICATIONS

This application claims the benefit of Provisional U.S. patent application Ser. No. 61/278,670 filed Oct. 8, 2009, Compact Embedded Antenna.

FEDERALLY SPONSORED RESEARCH

This invention was made in the course of performance of Contract No. W15P7T-09-C-S547 with the United States Army and the United States Government has rights in the invention.

FIELD OF INVENTION

This invention relates to radio antennas and in particular to compact radio antennas.

BACKGROUND OF THE INVENTION

An antenna is a transducer that transmits or receives electromagnetic waves. In other words, antennas convert electromagnetic radiation into electrical current, or vice versa. Physically, an antenna is an arrangement of one or more conductors, usually called elements in this context. In transmission, an alternating current is created in the elements by applying a rapidly changing voltage at the antenna terminals, causing the elements to radiate an electromagnetic field. In reception, the inverse occurs: an electromagnetic field from another source induces an alternating current in the elements and a corresponding voltage at the antenna's terminals. Antennas are used in systems such as radio and television broadcasting, point-to-point radio communication, wireless LAN such as WiFi or Bluetooth, cell phones, radar, GPS, remote controls, and spacecraft communication. Technological progress enables new antenna designs that are smaller, have wider bandwidth, and are more conformal. Generally these new designs are significant improvements to the earlier antenna elements.

There are many types of radio antennas: These include: dipole (simply two wires pointed in opposite directions arranged either horizontally or vertically, with one end of each wire connected to the radio and the other end hanging free in space), monopole (half of a dipole antenna, with a ground plane used to reflect a mirror image creating an effective dipole), patch, slot, conformal, spiral, Yagi-Uda (a directional variation of the dipole with parasitic elements added to focus the radiation pattern), horn (used where high gain is needed), parabolic (consists of an active element at the focus of a parabolic reflector to reflect the waves into a plane wave), bow tie, fractal and dielectric resonator antennas. These antenna designs are well known to persons skilled in the radio art.

Composites are engineered or naturally occurring materials made from two or more constituent materials with significantly different physical or chemical properties which remain separate and distinct at the macroscopic or microscopic scale within the finished structure. Composites are made up of individual materials referred to as constituent materials. There are two categories of constituent materials: matrix and reinforcement. At least one portion of each type is required. The matrix material surrounds and supports the reinforcement materials by maintaining their relative positions. The reinforcements impart their special mechanical and physical properties to enhance the matrix properties. A synergism produces material properties unavailable from the individual constituent materials, while the wide variety of matrix and strengthening materials allows the designer of the product or structure to choose an optimum combination. Common composites include woven fibers and a resin matrix to hold the fibers together in a rigid form. Examples of composite reinforcements include fiberglass, Kevlar, and carbon fiber. When mixed with a matrix, generally an epoxy resin, these materials form high strength composites. Other examples of composites are plywood, and the commonly used building material steel-reinforced concrete.

Composites have many uses, such as construction and carpentry. Composite materials are also widely used in ship building, aerospace structures, athletic equipment, high performance cars, storage tanks, vehicles and body armor. Different applications use different variations of a composite. A structural application may use one type of fiberglass weave with a particular resin, while an antenna application uses a different fiberglass weave and a different resin. A protective application may use Kevlar, while carbon fiber is being used in a lot of athletic equipment. One of the many benefits of using a composite is that there are so many possibilities one can design a composite for specific desired properties that may not be readily available.

Armor is a protective covering used to prevent damage from being inflicted to an object, individual or a vehicle through use of direct contact weapons or projectiles, usually during combat, or from damage caused by a potentially dangerous environment or action. Body armor is used by the military and private security to protect personnel from knife and bullet wounds. It generally consists of ceramic or composite plates positioned around the body. Vehicle armor is used to protect a vehicle and its occupants from injury due to impacts and explosions. It has traditionally been solid steel, though ceramics and composites have been used recently.

Land vehicles such as tanks and personnel carriers use armor to protect their occupants and enable completion of their mission. Weight is generally not a significant concern. Aircraft of all forms face similar threats to ground vehicles, but have very strict weight limits. Armor is limited to protecting personnel, and does not cover the whole vehicle. Composites and ceramics are often used due to their lighter weight. Ships and submarines need to limit damage from any explosions.

Armored vehicles typically require multiple antennas covering a broad frequency range for multiple functionalities including communication and sensing. Currently, many of these antennas are extended from the body of the vehicles. These protruding parts of the antennas are vulnerable to attacks, such as gunfire. Antennas become targets for anyone attaching a vehicle, in order to limit their communication abilities, and possibly prevent radio contact about the attack. With large antennas positioned around the vehicle, they are even occasionally shot off by our troops in the heat of battle. To solve this problem, many methods have been proposed including conformal antennas. Antennas which can conform to the surface of vehicles are in great demand for many military applications. Prior art conformal antennas are much less obvious and include antennas embedded in fiberglass or AstroQuartz composite materials, placed on top of the structure of a vehicle or used as the skin of the vehicle. However they are not protected by armor and can be easily damaged by enemy forces.

What is needed is conformal antennas can be embedded into vehicle armor so that the survivability of the antenna is increased greatly.

SUMMARY OF THE INVENTION

The present invention provides an antenna embedded into armor plates. The armor material is of low dielectric constant, preferably less than 20, permitting radio radiation to be emitted through the armor by the antenna. In a preferred embodiment the armor is a composite of different materials, with the antenna placed between elements of the armor, creating a multi-level design. The antenna elements are preferably printed for low-profile and ease of integration or the antenna elements can be fabricated from larger elements and placed into a space between vehicle and armor or in a cavity cut into the vehicle or armor.

BRIEF DESCRIPTION OF THE DRAWINGS

FIG. 6 shows changes to a preferred embodiment for operation at different frequencies.

DETAILED DESCRIPTION OF PREFERRED EMBODIMENTS

Figure 1:
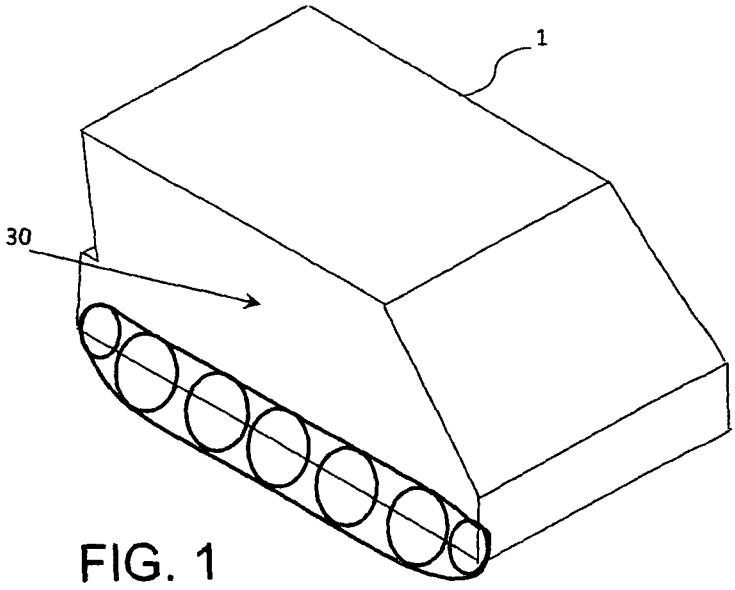
FIG. 1 is a line sketch showing the location of a preferred embodiment on the present invention on an armored personnel carrier.

A depiction of one possible antenna design embedded in a simple composite armor is shown in FIGS. 1, 2, 2A and 3. FIG. 1 is an outline sketch of an M113 Armored Personnel Carrier 1 showing a preferred location 30 on the right side of the vehicle of a preferred embodiment of the present invention. Preferably an identical antenna is located in a similar location on the left side of the vehicle. At frequencies of about 435 MHz these two antennae will provide full 360 degree coverage around the vehicle. The antenna is designed into the armor panel in such a way that it is not visible from the outside of the vehicle. The antenna is incorporated into the fabrication of the armor/vehicle with minor modifications to existing procedures. The antenna then gets hooked into an existing radio system for the communications.

The Antenna Unit

Figure 2:
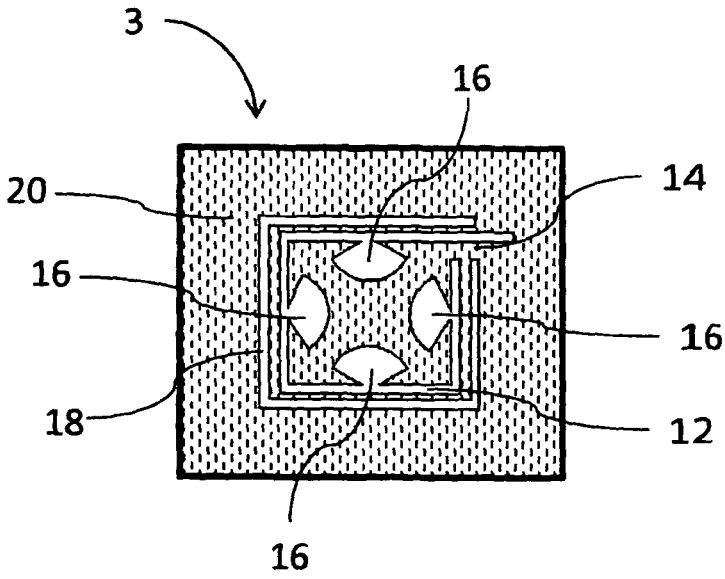
FIG. 2 shows features of a flat panel radiator.
Figure 2A:
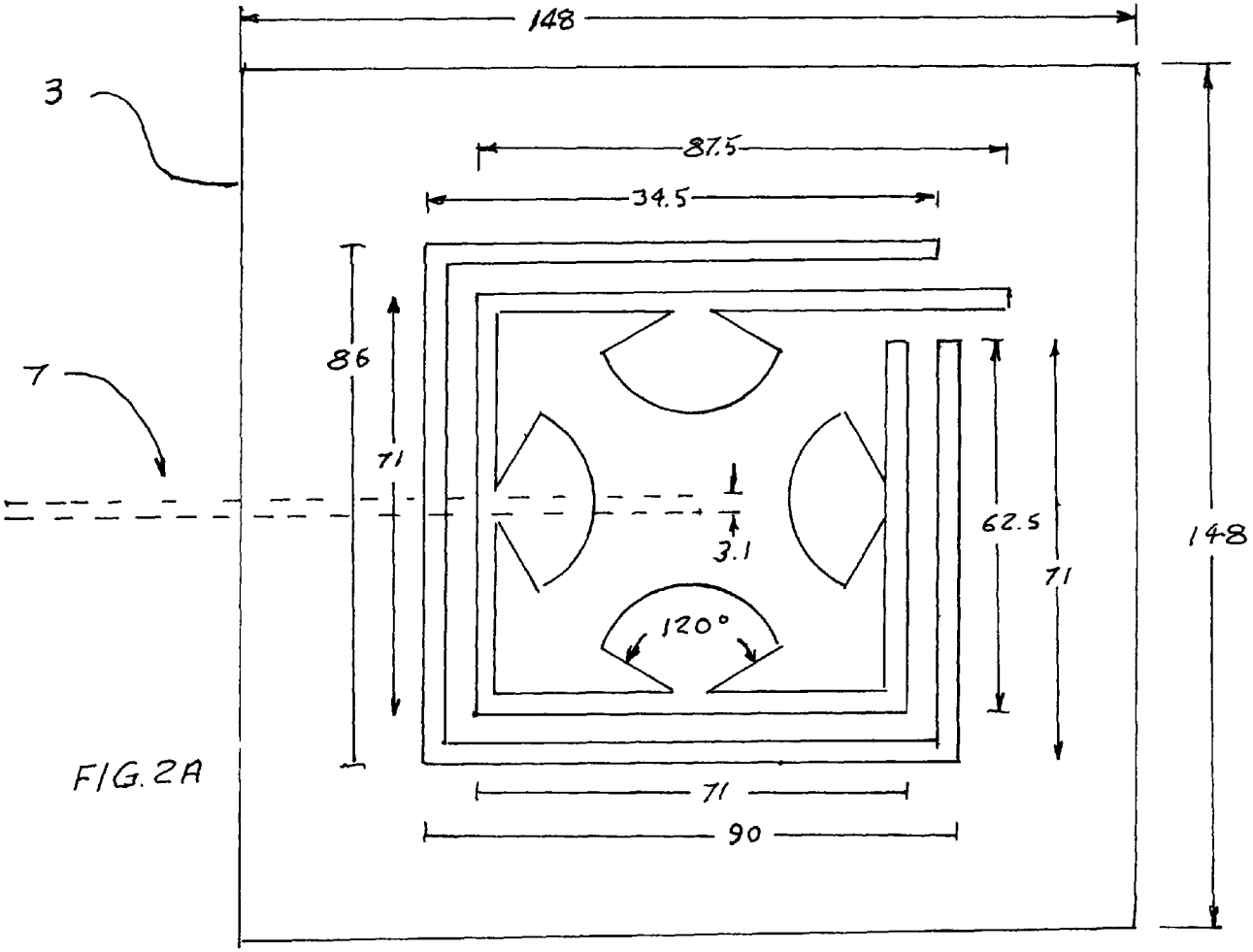
FIG. 2A shows precise dimensions of the flat panel radiator.

Preferred embodiments include a radiator unit comprising a flat panel radiator 3 and a feed line 7. The flat panel radiator 3 is shown in FIGS. 2 and 2A. This radiator is designed for operation at 435 MHz. This radiator 3 is fabricated from 0.01 inch thick copper sheet with a slot loop and periodically loaded slots cutout as shown in the figures. The copper sheet is a 148 mm×148 mm square. Radio waves are radiated from gaps 12, 16 and 18 cut in the copper sheet. For this preferred embodiment, the central radiator 12 defines an approximately square slot having a 3.5 mm width. Two sides are 71 mm, one side is 66 mm and the third side is about 91 mm, all as shown in FIGS. 2 and 2A. There is a small gap of 5 mm at one corner shown as 14 so the square is not complete. The side of the square that runs past the gap extends 20 mm beyond the ends of the square. In the center of each side of the square is a loaded slot 16, equivalent to a 120° slice of a circle with a radius of 17.6 mm.

This preferred radiator has a second 'parasitic' loop 18 around the outside of the central radiator. The parasitic loop forms a square with sides of 88 mm, and a width of 3.5 mm. The parasitic loop has a 5 mm gap to the extension of the original loop antenna that goes past the gap. The parasitic loop does not extend along with the extension of the original loop antenna—it ends where that side of the square ends, in line with the side cut short by the gap, at 84.5 mm length. The center of the parasitic loop and central antennas are the same, so the distance between them is the same around the square, except at the gap in one corner.

Precise dimensions of radiator 3 is shown in FIG. 2A along with the relative location and length of feed line 7 which is centered in the middle of one side of radiator 3 as shown in FIG. 2A and extends 1.4 mm beyond the center of radiator 3. Feed line 7 is separated from radiator 3 by a rubber sheet 6 as described in more detail below.

Embedding of the Radiator Unit

Figure 3:
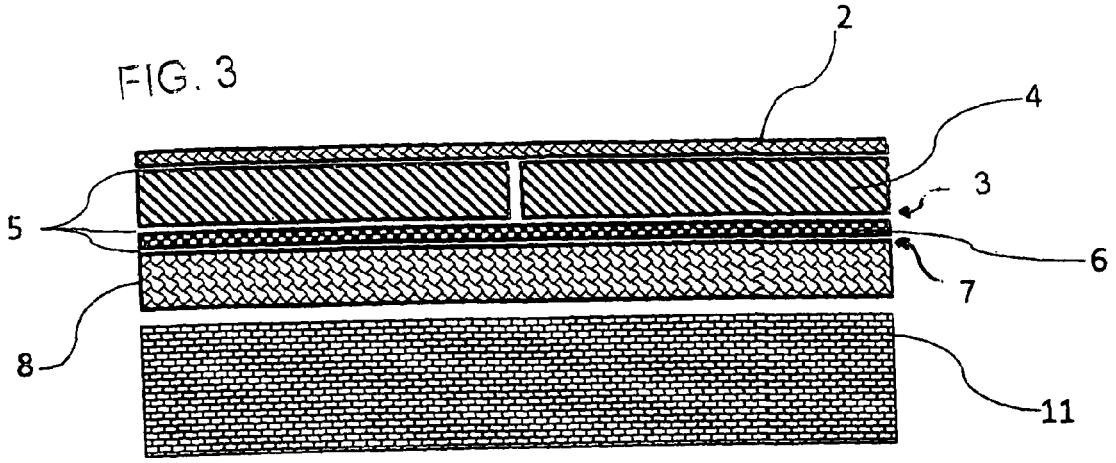
FIG. 3 shows several layers of material embedding a preferred embodiment.

The radiator unit 3 is embedded into an armor structure shown in FIG. 3. The armor structure includes thin, 1.25 mm thick, fiberglass face sheet 2, which covers 13 mm thick the ceramic tiles 4. The next layer is a 1.6 mm thick rubber spacer 6. Behind the rubber is a 13 mm thick fiberglass base 8. A thin, 0.1 mm thick, conductive floating ground element comprised of copper (not shown) is located behind the fiberglass base 8. The ground plane, located behind the fiberglass layer 8, is a continuous conductive surface and has an area of 100 mm×100 mm in the preferred embodiment. The flat panel radiator 3 is located between rubber layer 6 and ceramic layer 4, with the feed line located between the rubber layer 6 and fiberglass backing 8. The layers 2, 4, 6 and 8 are held together with a thin resin film 5 as shown in FIG. 3.

Once installed and connected, the antenna can be operated in the same fashion as existing antennas, thus eliminating part of the learning curve for using a new system.

Advantages of the Present Invention

In the preferred embodiment, the antenna is located behind the ceramic armor, before the thin rubber sheet and is therefore protected by the ceramic armor. The antenna is fed by a proximity feed line 7 on the back of the rubber sheet 6. The feed can extend a reasonable distance outside of the antenna to a location that is suitable for a connection, traditionally with an SMA connector (such as one from SparkFun Electronics, SKU: WRL-00593), to other components/electronics. The antenna is designed to have negligible impact on the properties of the armor, and during fabrication of the armor is inserted between the layers before they are bonded together with the resin 5. In preferred embodiments the armor described above is in addition to the vehicles existing armor 11.

The antenna is designed for use with the military's Enhanced Position Location Reporting System (EPLRS) which serves as a position location, navigation, identification and communications system. One of the radios that use this system is Raytheon's AN/TSQ-158. (Raytheon offices dealing with the AN/TSQ-158 are in Fullerton, Calif.). The EPLRS System is deployed on the M113 Armored Personnel Carrier (APC), and the armor can be used to protect the vehicle, with the actual antenna located on both sides of the vehicle at location 30 as shown in FIG. 1 for full coverage around the vehicle. The antenna and its associated armor can be mounted outside of the existing vehicle metal structure to provide additional personnel and equipment protection.

Figure 5:
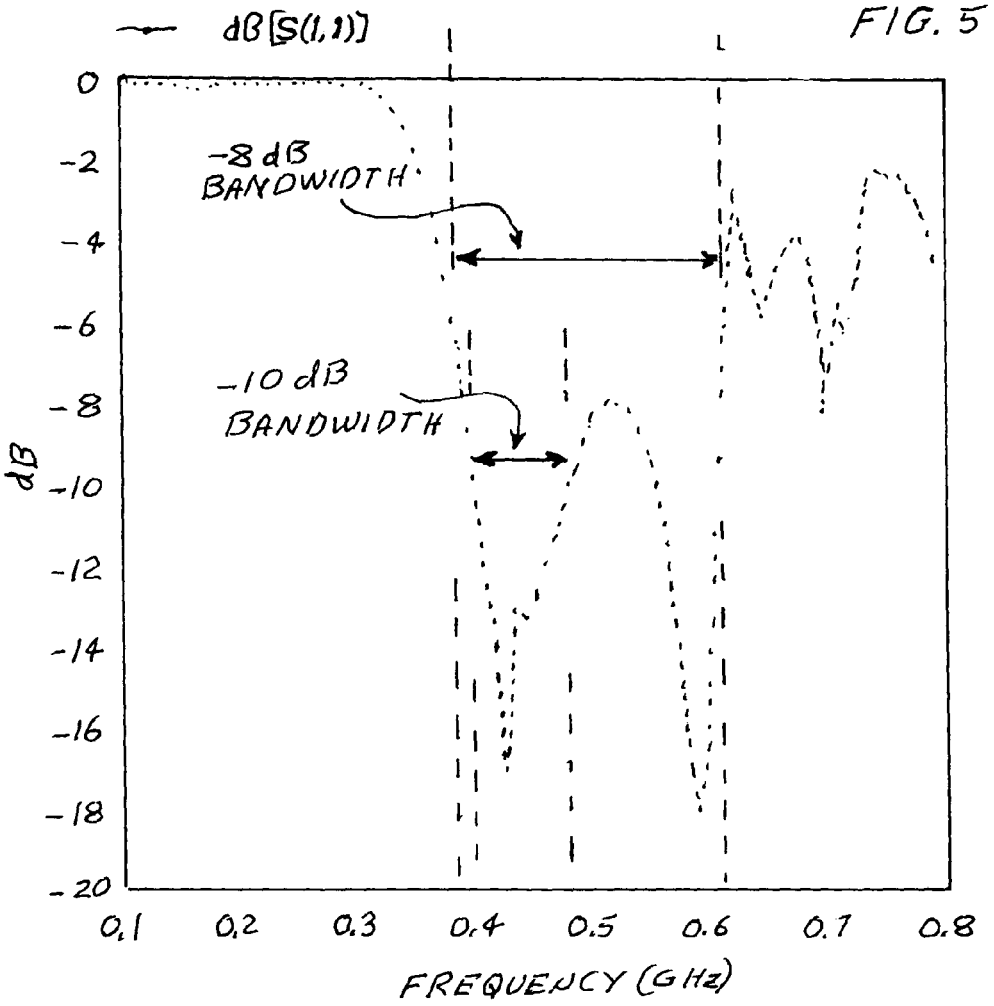
FIG. 5 shows antenna center frequency and bandwidth.
Figure 4A:
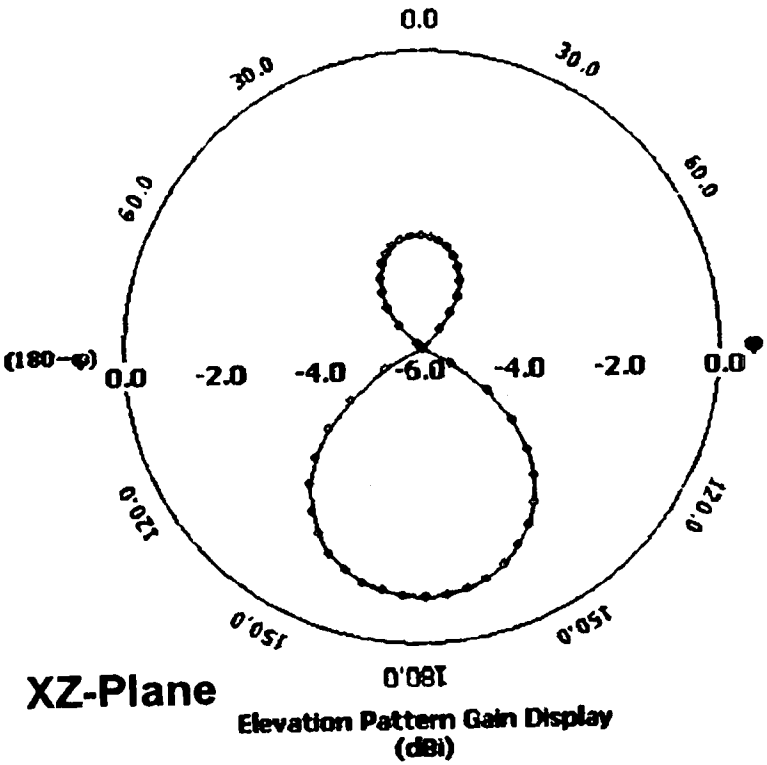
FIGS. 4A and 4B show radio beam patterns.
Figure 4B:
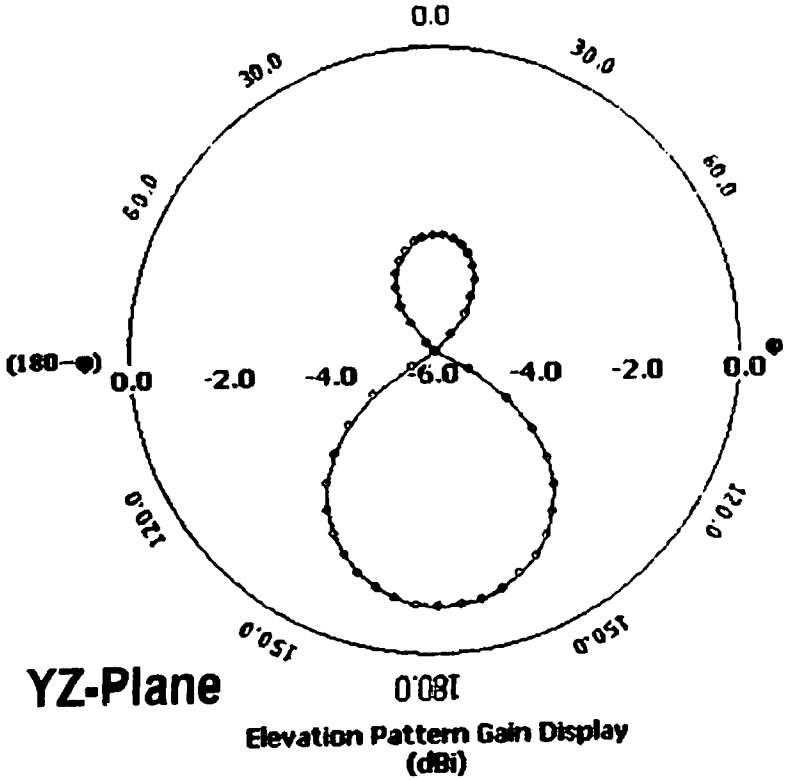

Simulations performed on the antenna design indicate a strongly directional radiation as shown in FIGS. 4A and 4B, which is useful for protecting anyone on the interior of the vehicle from the radio radiation. (In FIG. 4A and 4B zero degrees is down and 180 degrees is up.) Additionally, simulations were performed to determine the center frequency and bandwidth of the antenna as shown in FIG. 5.

Thus, the present invention provides an antenna that is hidden within the armor, or skin, of a vehicle, so the antenna is not visible and is also provided protection from damage. The invention would be primarily used by the military and associated entities, though the embedded concept and design can be applied to antennas on a multitude of civilian or commercial vehicles, such as aircraft, boats, and cars.

Variations

The present invention has been described in terms of a specific preferred embodiment. Persons skilled in the art of antennas will recognize that many other embodiments of the invention are easily possible. For example the antenna can be modified for operation with many different radios. Some of the variations are shown in FIG. 6 providing changes in the flat panel radiator for radios operating at frequencies different from 435 MHz. The antenna in the preferred embodiment can be modified to function at frequencies within a broad frequency range from 150 MHz to 2,000 MHz. For example, to operate at 300 MHz the antenna size would be increased to a square with sides 86 mm long, and a width of 2 mm. The loaded slots in the middle of each side are still centered in the middle of the strip that makes the square loop, and are still 120° cuts from a circle, but with a radius of 28 mm instead of 17.6 mm. The gap in the corner is reduced to simply removing the corner section and eliminating contact between the two sides—the physical gap between sides is only 1 mm, and both sides are equally shortened.

The antenna described in detail above has a second resonance that can be used to obtain higher frequency operation than the primary resonance. For instance, operation at 1470 MHz and 1800 MHz can be done with the same antenna. Persons skilled in the art will recognize that more than one resonance is available for the other designs as shown in FIG. 6

The preferred embodiment is realized as a slot antenna cut out from a conductive plane because it is highly damage tolerant. The antenna can also be made by a more common approach whereas the loop and loaded slots—the 120° slices from a circle—are conductive and the antenna is surrounded by non-conductive materials. In this embodiment the loop & loaded slots could be printed on the ceramic or rubber layers of the armor with a conductive ink, such as copper or silver.

Adjustments to the radiation pattern and bandwidth of the antenna can be realized with a different ground plane. The ground plane can be a small, repeating structure, generally called a metamaterial, that has specific conductive paths across it, but is not uniformly conductive.

In the preferred embodiment the antenna is embedded is a 4 layer composite, adding a total of 3 layers—one each for the radiating element, feed and ground plane. Other forms of the composite can be used for the antenna design as well, such as using Boron Nitride ceramic instead of Alumina. There can be more layers, with different properties, such as aramids or metals, depending on the threat rating of the armor. Materials should of course be chosen that will not substantially interfere with the radio transmission. The antenna will need to be adjusted for each variation in material properties and material thicknesses that is encountered since the material properties of the surrounding composite have a significant impact on the antenna performance. The antenna may also be inserted between different layers of the same composite structure, with modifications to account for the difference in material properties on both sides of the different components.

The armor described above can be used on any vehicle, though the most common armored vehicles are tanks, the HMMWVs (Humvees), various armored personnel carriers and Mine Resistant Ambush Protected (MRAP) vehicles.

What is claimed is:

1. An armor embedded radio antenna system for providing radio communication for an armored vehicle comprising:
- A) an armored vehicle,
- B) at least one embedded radio antenna system mounted on the armored vehicle, the antenna system comprising;
  - 1) at least one layer of low dielectric armor material,
  - 2) a flat panel radiator located behind said at least one layer of low dielectric armor material, the flat panel radiator comprising:
    - i) a central radiator comprised of four elongated slots defining an approximately square slot radiator,
    - ii) a loaded slot radiator surrounded by the central radiator,
    - iii) a parasitic loop radiator surrounding the central radiator;
  - 3) an insulator layer located behind said flat panel radiator, and
  - 4) a feed line located behind said insulator layer.

2. The armor embedded radio antenna system as in claim 1 wherein the ceramic is ceramic tile.

3. The armor embedded radio antenna system as in claim 1 wherein the ceramic is alumina.

4. The armor embedded radio antenna system as in claim 1 wherein the ceramic is boron nitrate.

5. The armor embedded radio antenna system as in claim 1 and also comprising a fiberglass sheet mounted outside the at least one layer of low dielectric armor material.

6. The armor embedded radio antenna as in claim 5 and also comprising a fiberglass base located behind said the insulator layer.

7. The armor embedded radio antenna system as in claim 1 wherein the armored vehicle is a vehicle chosen from the following group of vehicles:
- A) an armored personnel carrier,
- B) a tank,
- C) a HMMWV, and
- D) a mine resistant ambush protected vehicle.

8. An armor embedded radio antenna system for providing radio communication for an armored vehicle comprising:
- A) at least one layer of low dielectric ceramic material,
- B) a flat panel radiator located behind said at least one layer of low dielectric armor material,
- C) an insulator layer located behind said flat panel radiator, and
- D) a feed line located behind said insulator layer;

wherein the armor embedded antenna is mounted on an armored vehicle, the insulator layer is comprised of rubber and the flat panel radiator is comprised of a copper sheet comprising a slot loop with periodically loaded slots.

* * * * *

UNITED STATES PATENT AND TRADEMARK OFFICE

CERTIFICATE OF CORRECTION

PATENT NO. : 8,854,269 B2
APPLICATION NO. : 12/924968
DATED : October 7, 2014
INVENTOR(S) : Robert S. Bortolin et al.

It is certified that error appears in the above-identified patent and that said Letters Patent is hereby corrected as shown below:

On The Title Page,

Item (12) Bortoin et al. should read – Bortolin et al.

Item (76) Inventors: Robert S. Botoin should read – Robert S. Bortolin

Signed and Sealed this
Seventeenth Day of November, 2015

Michelle K. Lee

Michelle K. Lee
*Director of the United States Patent and Trademark Office*